United States Patent [19]

Berger

[11] 4,383,022

[45] May 10, 1983

[54] DIFFUSION TRANSFER FILM UNIT WITH PROTECTIVE LAYER OF WATER SOLUBLE COPPER SALT, CHITOSAN AND GELATIN

[75] Inventor: Michael Berger, Chestnut Hill, Mass.

[73] Assignee: Polaroid Corporation, Cambridge, Mass.

[21] Appl. No.: 392,882

[22] Filed: Jun. 28, 1982

Related U.S. Application Data

[63] Continuation-in-part of Ser. No. 277,945, Jun. 26, 1981, abandoned.

[51] Int. Cl.[3] ..... G03C 5/54; G03C 1/48; G03C 7/00

[52] U.S. Cl. ..... 430/228; 430/227; 430/231; 430/244; 430/245; 430/262

[58] Field of Search ..... 430/227, 228, 231, 244, 430/245, 262

[56] References Cited

U.S. PATENT DOCUMENTS 3,674,482 7/1972 Hablerlin ..... 430/228
4,056,392 11/1977 Scott ..... 430/227

*Primary Examiner*—Richard L. Schilling
*Attorney, Agent, or Firm*—Philip G. Kiely

[57] ABSTRACT

A silver diffusion transfer film unit which comprises, in order, a support carrying a silver precipitating layer, a protective layer comprising chitosan having a copper salt and gelatin disposed therein, a release layer and a photosensitive silver halide layer. In a particularly preferred embodiment, the film unit is an additive color diffusion transfer film unit.

19 Claims, 3 Drawing Figures

DIFFUSION TRANSFER FILM UNIT WITH PROTECTIVE LAYER OF WATER SOLUBLE COPPER SALT, CHITOSAN AND GELATIN

CROSS-REFERENCE TO RELATED APPLICATION

This application is a continuation-in-part of copending application Ser. No. 277,945, filed June 26, 1981, now abandoned.

BACKGROUND OF THE INVENTION

Procedures for preparing photographic images in silver by diffusion transfer principles are well known in the art. For the formation of the positive silver images, a latent image contained in an exposed photosensitive silver halide emulsion is developed and almost concurrently therewith a soluble silver complex is obtained by reaction of a silver halide solvent with unexposed and undeveloped silver halide of said emulsion. The photosensitive silver halide emulsion is developed with a processing composition which may be spread between the photosensitive element comprising the silver halide emulsion and a second element which may comprise a suitable silver precipitating layer. The processing composition effects development of the latent image in the emulsion and, substantially contemporaneous therewith, forms a soluble silver complex, for example, a thiosulfate or thiocyanate, with undeveloped silver halide. This soluble silver complex is at least in part transported in the direction of the print receiving layer and the silver thereof is precipitated in the silver precipitating element to form a positive image. Procedures of this description are disclosed, for example, in U.S. Pat. No. 2,543,181 issued to Edwin H. Land. See also Edwin H. Land, *One Step Photography*, Photographic Journal, Section A, pgs. 7–15, January 1950.

Additive color reproduction may be produced by exposing a photosensitive silver halide emulsion through an additive color screen having filter media or screen elements each of an individual additive color such as red or green or blue and by viewing the reversed or positive silver image formed by transfer to a transparent print receiving element through the same or a similar screen which is suitably registered with the positive image carried in the print receiving layer. As examples of suitable film structures for employment in additive color photography, mention may be made of U.S. Pat. Nos. 2,861,885; 2,726,154; 2,944,894; 3,536,488; 3,615,426; 3,615,427; 3,615,428; 3,615,429; and 3,894,871.

U.S. Pat. No. 3,674,482 issued July 4, 1972, is directed to a silver diffusion transfer film unit which comprises a support carrying on one surface, in order, a layer containing silver precipitating nuclei, an inert non-nuclei containing protective layer and a layer containing a photosensitive silver halide emulsion. The purpose of the non-nucleated protective layer is to provide a layer over the transferred silver image after the emulsion layer has been removed subsequent to processing, which protective layer will then be the outermost layer. The material for the protective layer is one which is readily permeable to the processing composition and which will not provide sites for the nucleation of the silver forming the transferred image. A particularly preferred material employed as a protective layer comprises chitosan (deacetylated chitin).

U.S. Pat. No. 4,056,392 issued Nov. 1, 1977 is directed to a diffusion transfer film unit which comprises, in order, an additive color screen, a layer comprising silver precipitating nuclei, a layer comprising a water-soluble cupric salt and a compound selected from the group consisting of chitosan and 2-amino-2-deoxyglucose, and a photosensitive silver halide emulsion layer. By employing a water-soluble copper salt in the chitosan protective layer, an increase in $D_{max}$ is achieved with substantially no adverse effect on $D_{min}$ compared to a protective layer composed of chitosan alone. The use of gelatin in the copper/chitosan layer is also disclosed. Amounts ranging from 0.3, 0.9 and 3.0 mgs/ft$^2$ of gelatin per 2.2 mgs/ft$^2$ of chitosan is disclosed. It is stated that as the amount of gelatin increases, the densities decrease and that any gelatin added to the copper/chitosan layer should be at a level less than one-half that of the chitosan.

SUMMARY OF THE INVENTION

The present invention is directed to a silver diffusion transfer film unit which comprises, in order, a support, a layer comprising silver precipitating nuclei, a protective layer comprising chitosan, a water-soluble salt of copper, and gelatin, a release layer, and a photosensitive silver halide emulsion layer. It should be understood that whenever a reference is made to a water-soluble salt of copper, the copper is added in the cupric valance state.

In a particularly preferred embodiment, the film unit is an additive color diffusion transfer film unit wherein the aforementioned support would carry an additive color screen.

DETAILED DESCRIPTION OF THE INVENTION

Figure 1:
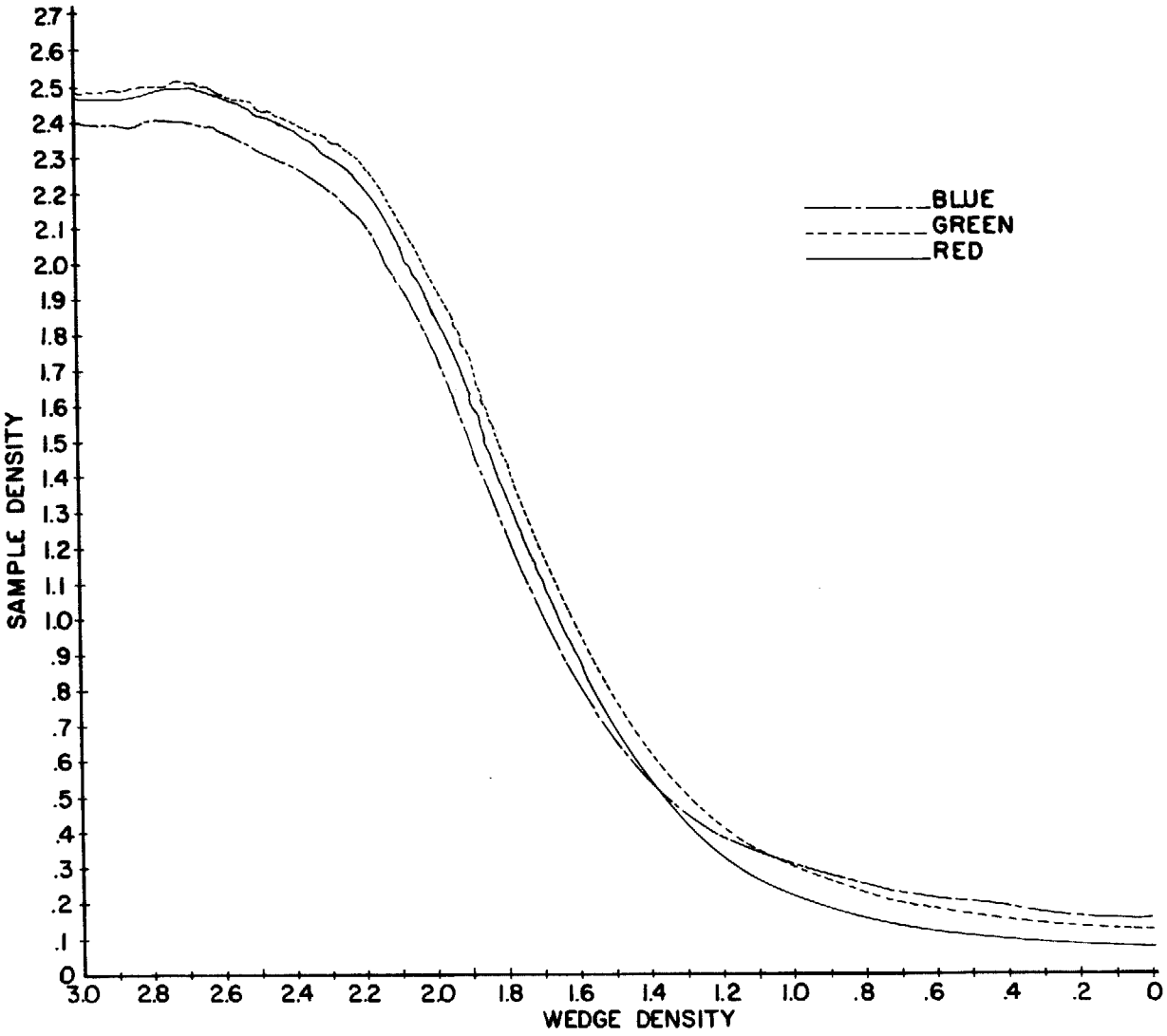
FIG. 1 is an H&D curve obtained from the film unit described in Example 4.

The above-mentioned patents describe the importance of the protective layer when the emulsion layer and other layers are detached from that portion of the film unit containing the positive silver image. The silver image must be protected from physical damage which may occur in processing the film unit or projection of the positive image. It is believed, however, that during storage of film units containing the copper/chitosan protective layer, a change in the chitosan occurs, probably an internal crosslinking. Thus, the protective layer can become, in effect, a barrier and inhibit the transfer of the soluble silver complex to the silver precipitating layer and not only increase processing composition imbibition times necessary to form a suitable transfer image but can also prevent sufficient silver complex from transferring to form an image of desired density.

It has now been found that substantial benefits are obtained in film units of the present invention which employ, as a protective layer, chitosan, copper and gelatin if the gelatin is employed at a level of at least about 1½ times, by weight, of the amount of chitosan.

Surprisingly, the novel protective layer of the present invention provides a greater degree of abrasion resistance to the processed film unit than the prior art copper/chitosan layer. Other advantages include a substantial image density increase as well as a more efficient removal of adjacent layers, as indicated by lack of residue on the protective layer subsequent to stripping, especially when the release layer of copending application of Michael Berger, Warren J. Dillman and Herbert L. Fielding, Ser. No. 277,616, filed June 26, 1981, and now abandoned (common assignee) is employed. The increase in density is surprising in light of the disclosure of U.S. Pat. No. 4,056,392 wherein an increase in gelatin to levels less than 1½ times that of chitosan produced a loss of density.

Substantially any water-soluble salt of copper may be employed in the present invention. Since it is the cupric ion which is believed to be the active moiety, the anion is not critical. However, care should be taken that an anion which would be detrimental to the photographic process not be employed. It should be understood that while the copper is added as the cupric ion, it is not known if any valence change occurs in the protective layer by the action of the other materials in the protective layer. As used herein, reference to cupric ion indicates the valance state of the copper salt when it is added to the materials forming the protective layer. In a preferred embodiment the water-soluble salt employed in the present invention is copper acetate or copper gluconate.

The coverage of the protective layer may range up to about 40 mg/ft$^2$. Preferably the layer is in excess of 5 mg/ft$^2$.

The ratio of the components of the protective layer may vary over a relatively wide range. In a preferred embodiment, the composition of the protective layer may comprise chitosan ranging from about 1-13 mg/ft$^2$; copper ion ranging from about 0.1-4 mg/ft$^2$ and weight gelatin ranging from about 2-20 mg/ft$^2$ wherein the gelatin is at least 1½ times, by weight of the chitosan. The preferred ratio of chitosan to copper ion is about 10 to 1.

comprising palladium nuclei at a coverage of about 0.23 mg/ft$^2$ of palladium (prepared according to the procedure of U.S. Pat. No. 4,281,056, issued July 28, 1981), 0.23 mg/ft$^2$ of gelatin and 1.0 mg/ft$^2$ of hydroxyethyl cellulose; a protective layer as described below; a release layer as described below; a hardened gelatino silver iodobromide emulsion panchromatically sensitized at a silver coverage indicated below; a top coat comprising gelatin, antihalation dyes and about 15 mg/ft$^2$ of 3μ silica particles.

Film units described above were prepared employing the protective layers and silver coverages designated below. The film units were exposed at 16 mcs at 5500° K. to a multi-color target and processed with mechanical rollers by disposing the processing composition between the top coat and a stripping sheet. The film was held in the dark for one minute and then the top coat and emulsion layers were removed with the stripping sheet.

| Processing Composition | Weight % |
|---|---|
| Sodium hydroxide | 8.54 |
| Hydroxyethyl cellulose (sold by Hercules, Inc., Wilmington, Delaware under the tradename Natrosol 250 HH) | 1.36 |
| Tetramethyl reductic acid | 5.83 |
| Potassium bromide | 0.68 |
| Sodium sulfite | 0.90 |
| 2-methylthiomethyl-4,6-dihydroxypyrimidine | 6.22 |
| 4-aminopyrazolo-[3,4d]-pyrimidine | 0.02 |
| N—benzyl-α-picolinium bromide (50% solution) | 3.11 |
| Water | 73.35 |

Densities and speeds obtained from the H&D curves generated on an automatic recording densitometer are set forth in the Table. The $D_{mins}$ reported are density values above the density of the film base and color screen.

TABLE 1

| Example | Protective Layer mg/ft$^2$ as Coated | mg/ft$^2$Ag | $D_{max}/D_{min}$ Red | Green | Blue | 0.7 Speed Red | Green | Blue | Surface of Processed Protective Layer | Abrasion Resistance |
|---|---|---|---|---|---|---|---|---|---|---|
| 1 (Control) | 1.1 copper acetate 3.25 chitosan | 89.6 | 2.26/0.06 | 2.35/0.10 | 2.27/0.10 | 2.16 | 2.13 | 2.24 | Moderate visible residue | Good |
| 2 | 1.1 copper acetate 3.25 chitosan 5.2 glycerol | 88.6 | 2.32/0.07 | 2.43/0.12 | 2.37/0.13 | 2.19 | 2.16 | 2.25 | Moderate visible residue | Good |
| 3 | 1.1 copper acetate 3.25 chitosan 5.2 gelatin | 90.5 | 2.71/0.09 | 2.71/0.16 | 2.46/0.17 | 2.17 | 2.15 | 2.27 | Very little visible residue | Very good |

Processed at 0.0020 in. gap.

Stripping sheet: polyester support carrying 500 mg/ft$^2$ gelatin and 50 mg/ft$^2$ zinc acetate Release layer: hydroxyethyl cellulose/polyethylene emulsion 6/2 mg/ft$^2$ The hydroxyethyl cellulose was NATROSOL 250L sold by Hercules, Inc. Wilmington, Del.

The following non-limiting example illustrates the novel film units of the present invention.

EXAMPLE A

A film unit was prepared comprising a transparent polyester film base and carrying on one surface an additive color screen of approximately 1500 lines each per inch of red, blue, and green filter screen elements in repetitive side by side relationship; a 2.3μ polyvinylidine chloride/polyvinyl formal layer; a nucleating layer Table 1 shows that the novel protective layer of the present invention provides added abrasion resistance, increased densities and provides for a clean release of the detached layers, i.e., very little residue or retention of the release layer or emulsion layer. Example 2, included for comparative purposes is disclosed in copending application of Michael Berger, Charles H. Byers and John J. Magenheimer, Ser. No. 277,946, filed June 26, 1981 (common assignee) and now abandoned.

TABLE 2

| Example | Protective Layer mg/ft² as Coated | mg/ft²Ag | $D_{max}/D_{min}$ Red | Green | Blue | 0.7 Speed Red | Green | Blue | Surface of Processed Protective Layer | Abrasion Resistance |
|---|---|---|---|---|---|---|---|---|---|---|
| 4 | 1.1 copper acetate<br>3.25 chitosan<br>0.65 glycerol | 89 | 2.58/0.07 | 2.50/0.15 | 2.40/0.15 | 2.17 | 2.13 | 2.23 | Some visible residue | good |
| 5 | 1.1 copper acetate<br>3.25 chitosan<br>5.2 gelatin | 90 | 2.77/0.09 | 2.82/0.16 | 2.65/0.20 | 2.14 | 2.11 | 2.21 | Very little visible residue | very good |
| 6 | 0.55 copper acetate<br>1.63 chitosan<br>2.6 gelatin | 88.5 | 2.71/0.08 | 2.69/0.12 | 2.25/0.11 | 2.12 | 2.13 | 2.22 | Little visible residue | good |

Processed at 0.0020 in. gap.
Stripping sheet: polyester support carrying 500 mg/ft² gelatin and 50 mg/ft² zinc acetate
Release layer: Example 4; hydroxyethyl cellulose/polyethylene emulsion 6/2 mg/ft²
Examples 5 & 6; hydroxyethyl cellulose/carboxymethyl cellulose/polyethylene emulsion 5/1/2 mg/ft²

Figure 2:
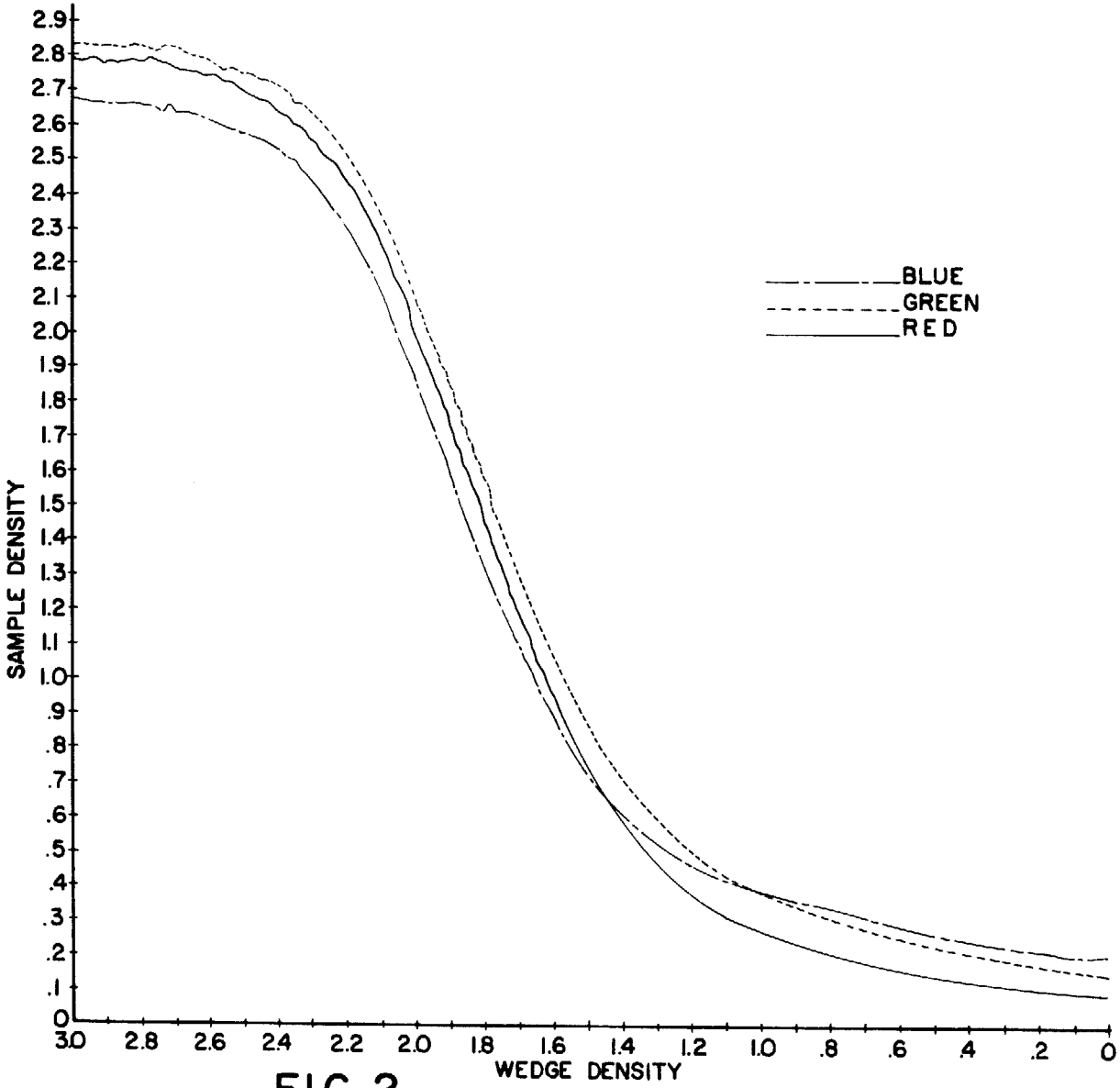
FIG. 2 is an H&D curve obtained from the film unit described in Example 5.
Figure 3:
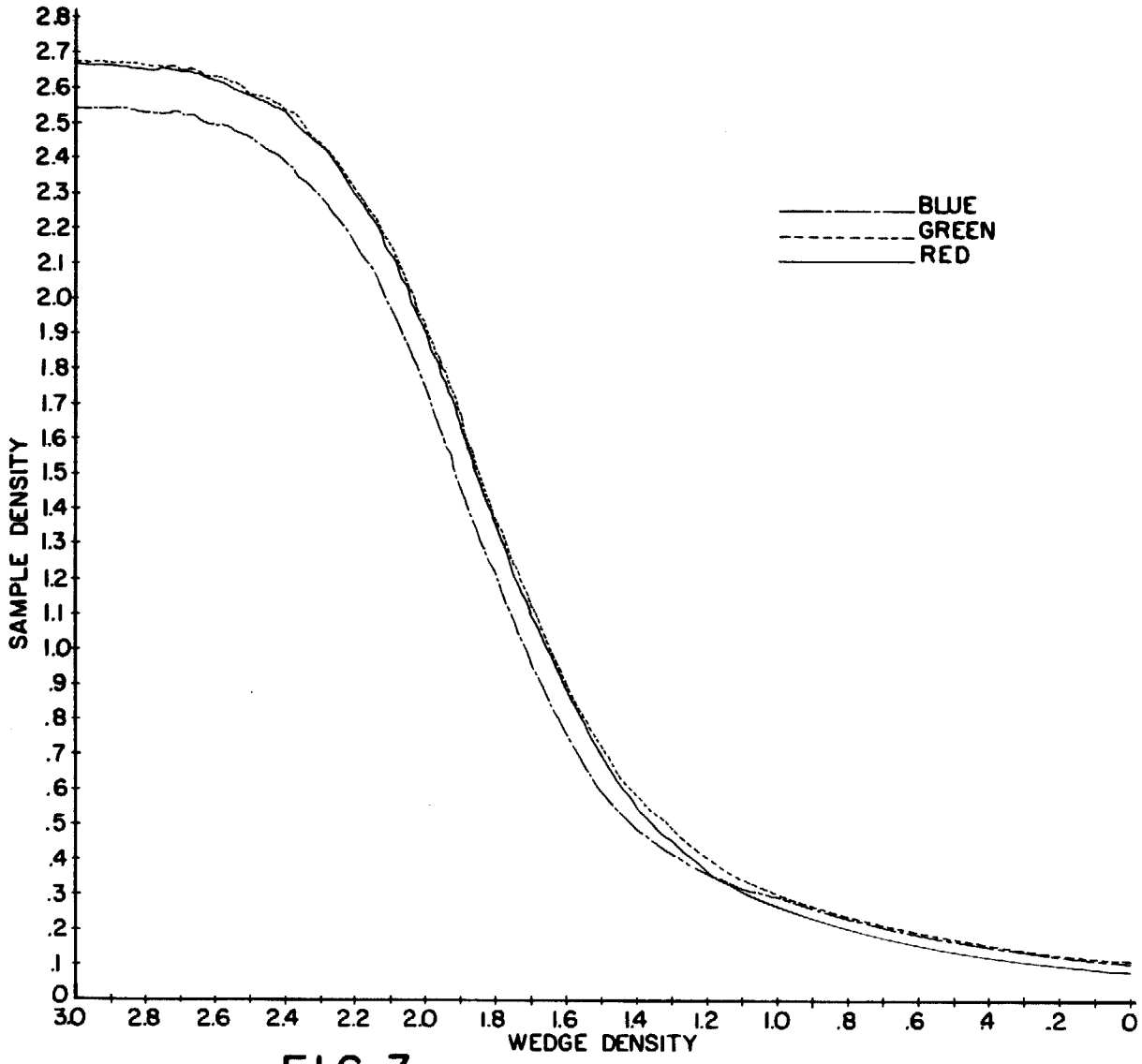
FIG. 3 is an H&D curve obtained from the film unit described in Example 6.

Table 2 shows that the lower coverage of the protective layer containing gelatin (Example 6) shows some loss in abrasion resistance and the surface of the protective layer retains slightly more residue after stripping. While there is a slight density loss associated with a lower coverage of protective layers containing gelatin, neutral column sensitometry is improved as indicated by FIGS. 1, 2 and 3 which are H&D curves for Examples 4, 5 and 6 respectively. It will be seen that with the lower coverage of the protective layer (Example 6) there is less curve crossing and a more consistent image tone over all exposures.

Table 3 shows the effect of various levels of gelatin in the protective layer.

TABLE 3

| Example | Protective Layer mg/ft² as Coated | $D_{max}/D_{min}$ Red | Green | Blue | 0.7 Speed Red | Green | Blue | Surface of Processed Protective Layer | Abrasion Resistance |
|---|---|---|---|---|---|---|---|---|---|
| 7 (Control) | None | 2.54/0.03 | 2.68/0.02 | 2.27/0.03 | 2.06 | 1.95 | 1.92 | Noticeable residue | 1–5 |
| 8 | 1.1 copper acetate<br>3.25 chitosan<br>5.2 gelatin | 2.76/0.07 | 2.81/0.13 | 2.65/0.19 | 2.15 | 2.11 | 2.10 | Almost no residue | 15–25 |
| 9 | 1.1 copper acetate<br>3.25 chitosan<br>4.0 gelatin | 2.63/0.10 | 2.64/0.15 | 2.49/0.20 | 2.17 | 2.17 | 2.15 | Almost no residue | 15–20 |
| 10 | 1.1 copper acetate<br>3.25 chitosan<br>3.0 gelatin | 2.57/0.08 | 2.50/0.14 | 2.43/0.14 | 2.16 | 2.14 | 2.13 | Slightly more residue than Example 9 | 5–10 |

Processed at 0.0020 in. gap
Stripping sheet: Polyester support carrying 500 mg/ft² gelatin and 50 mg/ft² zinc acetate
Release layer: Example 7; Hydroxyethyl cellulose/carboxylated methacrylic acid/acrylic acid copolymer base soluble wax 12/1 mg/ft².
Example 8; Hydroxyethyl cellulose/polyethylene emulsion 6/2 mg/ft²
Examples 9 & 10; Hydroxyethyl cellulose/carboxymethyl cellulose/polyethylene emulsion 5/1/2 mg/ft²
Abrasion resistance: Minimum number of passes with stylus abrader (ANSI PH1.37-1979) to cause scratching perceptible in transmitted light.

From Table 3 it will be seen that higher coverages of gelatin in the protective layer gives both higher $D_{max}$ and $D_{min}$ while providing superior abrasion resistance and a clean surface after processing. The lower amount of gelatin in the protective layer, i.e., amounts less than 1½ times the level of chitosan, results in a decrease in abrasion resistance and slight increase in retained material on the protective layer after stripping as well as the lower densities, as predicted by U.S. Pat. No. 4,056,392. In fact, it will be noted that the densities observed in Examples 9 and 10 are significantly lower than those of Example 8, and in fact, are essentially the same as the control, or even poorer, in the case of Example 10.

It is also important that the protective layer coact with the release layer to provide both pre-processing adhesion to the adjacent layers to provide for film unit integrity during assembly and use as well as clean and easy separation of the desired layers subsequent to processing. Protective layers of the present invention show increased pre-processing adhesion compared to a protective layer without gelatin. This comparison is made in Table 4 where it will be seen that although both film units strip readily after processing, Example 12 shows significantly increased pre-processing adhesion.

TABLE 4

| Example | mg/ft² as Coated | Peel Strength g/in |
|---|---|---|
| 11 | 1.2 copper acetate<br>3.25 chitosan | 16.5 |
| 12 | 1.1 copper acetate<br>3.25 chitosan<br>5.2 gelatin | 26 (avg. of 3) |

The release layer in both examples was hydroxyethyl cellulose/polyethylene emulsion 6/2 mg/ft².

The gelatin in the above-described protective layers was deionized bone gel.

The support employed in the present invention is not critical. The support or film base employed may comprise any of the various types of rigid or flexible supports. For example, glass, polymeric films of both the synthetic type and those derived from natural occuring products, including paper, may be employed. If a transparency is desired, a transparent support is employed; if a reflection print is desired, an opaque support is employed. Especially suitable materials comprise flexible transparent synthetic polymers such as polymethylacrylic acid; methyl and ethyl esters; vinyl chloride polymers; polyvinyl acetals; polyamides such as nylon; polyesters such as the polymeric films derived from ethylene glycol terethalic acid; polymeric cellulose derivitives such as cellulose acetate propionate; polycarbonates; polystyrenes and the like.

The additive color screen employed in the present invention may be formed by techniques well known in the art. For example, by sequentially printing the requisite filter patterns by photomechanical methods. An additive color screen comprises an array of sets of colored areas or filter elements usually from 2–4 different colors, each of said sets of colored areas being capable of transmitting visible light within a predetermined wavelength range. In the most common situations, the additive color screen is trichromatic and each set of color filter elements transmits light within one of the so called primary wavelength ranges, i.e., red, green, or blue. The additive color screen may be composed of minute dyed particles such as starch grains or hardened gelatin particles intermixed and interspersed in a regular or random arrangement to provide a mosaic. A regular mosaic of this type may be made by an alternating embossing and doctoring technique described in U.S. Pat. No. 3,019,124. Another method of forming a suitable color screen comprises multi-line extrusion of the type disclosed in U.S. Pat. No. 3,032,008, the colored lines being deposited side-by-side in a single coating operation. Still another method is set forth in U.S. Pat. No. 3,284,208.

Silver halide solvents useful in forming the desired soluble complex with unexposed silver are well known and, for example may be selected from the alkali metal thiosulfates, particularly sodium or potassium thiosulfates, or the silver halide solvent may be a cyclic imide, such as uracil, in combination with a nitrogenous base as taught in U.S. Pat. No. 2,857,274 issued Oct. 21, 1958 to Edwin H. Land or pseudouracils, such as the 4,6-dihydroxy-pyrimidines as taught in U.S. Pat. No. 4,126,459, issued Nov. 21, 1978. While the silver halide solvent is preferably initially present in the processing composition, it is within this invention to initially position the silver halide solvent in a layer of the film unit, preferably in the form of a precursor which releases or generates the silver halide solvent upon contact with an alkaline processing fluid.

The processing composition may contain a thickening agent, such as an alkali metal carboxymethyl cellulose or hydroxyethyl cellulose, in a quantity and viscosity grade adapted to facilitate application of the processing composition. The requisite alkalinity, e.g., a pH of 12–14, is preferably imparted to the processing composition, by employing, for example, sodium potassium and/or lithium hydroxide. A wetting agent may be advantageously included in the processing composition to facilitate application thereof, particularly where the processing composition is applied in a very thin layer of low viscosity fluid.

Suitable silver halide developing agents may be selected from amongst those known in the art, and may be initially positioned in a layer of the photosensitive element and/or in the processing composition. Organic silver halide developing agents are generally used, e.g., organic compounds of the benzene or naphthalene series containing hydroxyl and/or amino groups in the para- or ortho-positions with respect to each other, such as hydroquinone, tert-butyl hydroquinone, toluhydroquinone, p-aminophenol, 2,6-dimethyl-4-aminophenol, 2,4,6-triaminophenol, etc. If the additive color transparency is one which is not washed after processing to remove unused silver halide developing agent, development reaction products, etc., the silver halide developing agent(s) should not give rise to colored reaction products which might stain the image or which, either unreacted or reacted, might adversely affect the stability and sensitometric properties of the final image. Particularly useful silver halide developing agents having good stability in alkaline solution are substituted reductic acids, particularly tetramethyl reductic acid, as disclosed in U.S. Pat. No. 3,615,440 issued Oct. 26, 1971 to Stanley M. Bloom and Richard D. Cramer, and $\alpha,\beta$-enediols as disclosed in U.S. Pat. No. 3,730,716 issued to Edwin H. Land, Stanley M. Bloom and Leonard C. Farney on May 1, 1973.

What is claimed is:

1. A silver diffusion transfer film unit which comprises a support carrying, in order, a layer comprising silver precipitating nuclei; a protective layer comprising a water soluble copper salt, chitosan and gelatin wherein said gelatin is at least about 1½ times, by weight, of the level of chitosan; a release layer; and a photosensitive silver halide emulsion layer.

2. The film unit of claim 1 wherein said support is transparent.

3. The film unit of claim 1 wherein said support is opaque.

4. The film unit of claim 2 which includes an additive color screen.

5. The film unit of claim 1 wherein said copper salt is copper acetate.

6. The film unit of claim 1 wherein copper ion from said copper salt ranges from about 0.1 to 4 mg/ft$^2$; said chitosan ranges from about 1 to 13 mg/ft$^2$; and said gelatin ranges from about 2 to 20 mg/ft$^2$.

7. The film unit of claim 6 wherein the ratio of chitosan to copper ion is about 10 to 1, by weight.

8. The film unit of claim 1 which includes a layer containing an antihalation compound.

9. The film unit of claim 1 wherein said silver precipitating nuclei are noble metal nuclei.

10. The film unit of claim 9 wherein said nuclei are palladium nuclei.

11. A photographic process which comprises the steps of:

(a) exposing a film unit which comprises a support carrying, in order, a layer comprising silver precipitating nuclei; a protective layer comprising a water soluble copper salt, chitosan and gelatin said gelatin being at least about 1½ times, by weight, of the level of chitosan; a release layer; and a photosensitive silver halide emulsion layer;

(b) contacting said exposed film unit with a processing composition containing a silver halide developing agent and a silver halide solvent adapted to provide a positive silver image in said layer comprising silver precipitating nuclei; and (c) detaching said emulsion subsequent to positive image formation.

12. The process of claim 11 wherein said support is transparent.

13. The process of claim 11 wherein said support is opaque.

14. The process of claim 12 herein said film unit includes an additive color screen.

15. The process of claim 11 wherein said copper salt is copper acetate.

16. The process of claim 11 wherein said copper ion from copper salt ranges from about 0.1 to 4 mg/ft$^2$; said chitosan ranges from about 1 to 13 mg/ft$^2$; and said gelatin ranges from about 2 to 20 mg/ft$^2$.

17. The process of claim 16 wherein the ratio of chitosan to copper ion is about 10 to 1 by weight.

18. The process of claim 11 wherein said emulsion layer is removed subsequent to positive image formation.

19. The process of claim 11 wherein said film unit includes a layer containing an antihalation compound.

* * * * *